US007438158B2

(12) United States Patent
Heinzer et al.

(10) Patent No.: US 7,438,158 B2
(45) Date of Patent: Oct. 21, 2008

(54) SAFETY MONITORING DEVICE WITH INSTANTANEOUS SPEED DETERMINATION FOR A LIFT CAR

(75) Inventors: Volker Heinzer, Bochum (DE); Olav Hennemann, Munster (DE)

(73) Assignee: K.A. Schmersal Holding KG, Wuppertal (DE)

( * ) Notice: Subject to any disclaimer, the term of this patent is extended or adjusted under 35 U.S.C. 154(b) by 522 days.

(21) Appl. No.: 11/045,939

(22) Filed: Jan. 27, 2005

(65) Prior Publication Data

US 2005/0230191 A1 Oct. 20, 2005

(30) Foreign Application Priority Data

Feb. 20, 2004 (DE) ..... 10 2004 009 250

(51) Int. Cl.
*B66B 1/28* (2006.01)

(52) U.S. Cl. ..... 187/248; 187/394

(58) Field of Classification Search ..... 187/391–394, 187/286–288, 293, 295–297, 305, 313, 247, 187/248
See application file for complete search history.

(56) References Cited

U.S. PATENT DOCUMENTS 3,902,572 A * 9/1975 Ostrander ..... 187/293
5,070,967 A 12/1991 Katzy et al.
5,274,203 A * 12/1993 Skalski et al. ..... 187/393
5,736,695 A * 4/1998 Hoepken ..... 187/394
5,883,345 A * 3/1999 Schonauer et al. ..... 187/394
7,204,347 B2 * 4/2007 Schonauer et al. ..... 187/394
7,228,943 B2 * 6/2007 Kugiya et al. ..... 187/393

FOREIGN PATENT DOCUMENTS

DE 101 46 044 A1 4/2003
DE 10150463 4/2003
EP 0 773 180 A 5/1997
EP 0926509 6/1999

* cited by examiner

*Primary Examiner*—Jonathan Salata
(74) *Attorney, Agent, or Firm*—Townsend and Townsend and Crew LLP

(57) ABSTRACT

A safety monitoring device is provided for a lift car which can be moved in a lift shaft by a traction drive via a lift control system and whose instantaneous position can be registered by a position registering device which supplies two position signals, produced independently of each other, in a predetermined time pattern, having two-channel evaluation of the position signals by means of a microprocessor in each case for location-dependent, instantaneous determination of the speed of the lift car and for comparison with a predefined movement profile, it being possible for a trigger signal that can be output via a safety relay stage to be generated if a predetermined instantaneous speed desired value is exceeded.

8 Claims, 3 Drawing Sheets

SAFETY MONITORING DEVICE WITH INSTANTANEOUS SPEED DETERMINATION FOR A LIFT CAR

FIELD OF THE INVENTION

The invention relates to a safety monitoring device for a lift car.

BACKGROUND OF THE INVENTION

In lifts it is usual to provide safety functions in order to monitor the travel behaviour of the lift car (or of the lift cage) in order that accidents can be avoided.

For this purpose, for example, a device for monitoring retardation is provided. In the lift shaft there are mechanical buffers on the pit and top side, which are used to brake the lift car in the event of an emergency. However, one precondition for this is that the speed of the lift car does not exceed a predetermined limiting value. In order to achieve this, if the limiting value is exceeded, the braking device for the lift car must be set operating early enough in order that sufficient braking, which takes place in accordance with a braking ramp, can be carried out in such a way that the buffers can perform the residual braking. For this purpose, it is known for the device for monitoring retardation to comprise electromechanical switches arranged in the shaft at an appropriate point and coupled to a safety relay module and, when they are reached during a lift travel in the direction of the buffers and if the limiting value for the speed is exceeded, for the cabin braking to be triggered and, at the same time, the drive to be switched off.

Furthermore, it is known to provide a mechanical device for limiting the speed of the lift car, which is used to trigger a braking system fixed to the lift car and under the control of centrifugal force when a predetermined desired value of the speed of the lift car is exceeded.

In addition, it is known to provide a device for approaching and, if necessary, readjustment with open doors, a bridging device being provided for electromechanical door contacts which monitor whether the shaft door is closed. In the case of high buildings with very many storeys, in order to save travelling time, provision is made to begin to open the doors at a specific distance before the selected storey position is reached, that is to say as the latter is approached, so that they are open when this position is reached. If a relatively large load is introduced into a lift car or is removed from the latter, the floor of the lift car moves in relation to the floor level of the corresponding storey at which the lift car is standing. In order that readjustment can be carried out to align the floor level of lift car and storey with the doors open, it is likewise necessary to bridge the door contacts in an appropriate manner. The same is correspondingly true of the case in which adaptation of the floor height of the lift car to a loading ramp height, for example of an HGV, is to be carried out, what is known as ramp travel control.

Mechanically based safety devices of this type do not permit continuous monitoring, only that at a point.

For example, EP 0 694 792 B1 and EP 1 030 190 B1 disclose a device for registering the position of a lift car, there being in the lift shaft an acoustic signal conductor having a predetermined, uniform velocity of propagation of sound, while the lift car has a signal injector for injecting a clocked acoustic signal into the acoustic signal conductor. Arranged at both ends of the acoustic signal conductor are signal extractors, which are connected to an evaluation unit for determining the propagation time difference of the injected acoustic signal from the injection point to the signal extractors and for generating a signal representative of the instantaneous position of the lift car in the lift shaft.

SUMMARY OF THE INVENTION

The object of the invention is to provide a safety monitoring device for a lift car which permits continuous safety monitoring.

According to the invention, as a result of a two-channel evaluation of position signals from the lift car by a microprocessor in each case, the speed and, if appropriate, the acceleration (and also possibly its derivative) of the lift car is determined instantaneously in a location-dependent manner here and is compared with a predefined movement profile; if a predetermined desired value is exceeded it is possible to generate a trigger signal, so that the safety monitoring device can be used for one or more of the safety functions mentioned at the beginning and below in the corresponding case of a fault. In this way, continuous monitoring is possible not just in relation to a specific desired value but in relation to a desired curve.

Further objects, advantages and embodiments of the invention can be gathered from the following description and the claims.

BRIEF DESCRIPTION OF THE DRAWINGS

The invention will be explained in more detail below using an exemplary embodiment illustrated in the appended figures.

DETAILED DESCRIPTION OF A PREFERRED EMBODIMENT

Figure 1:
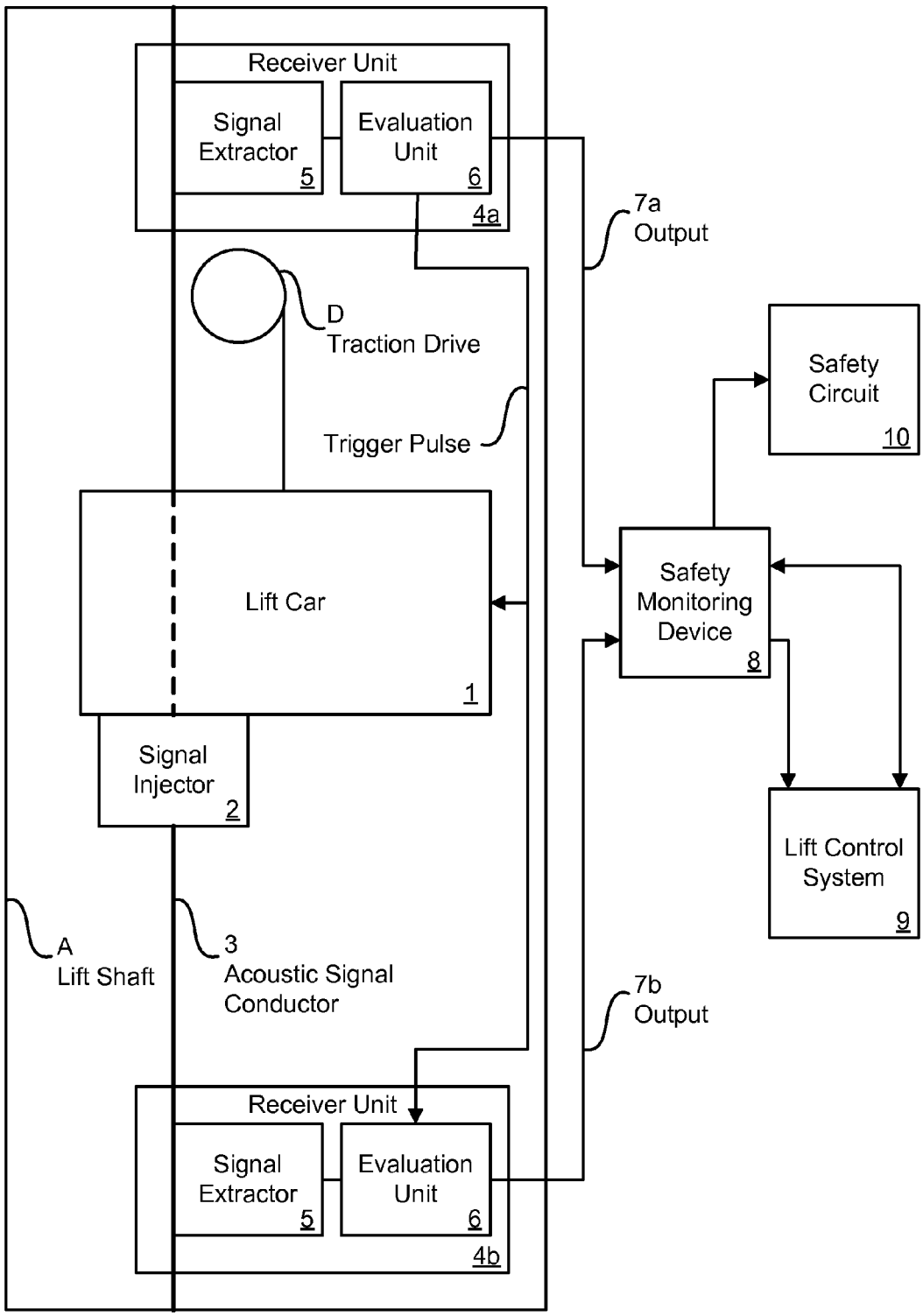
FIG. 1 shows a block diagram of a lift monitoring and control system having a position registering device for a lift car.
Figure 2:
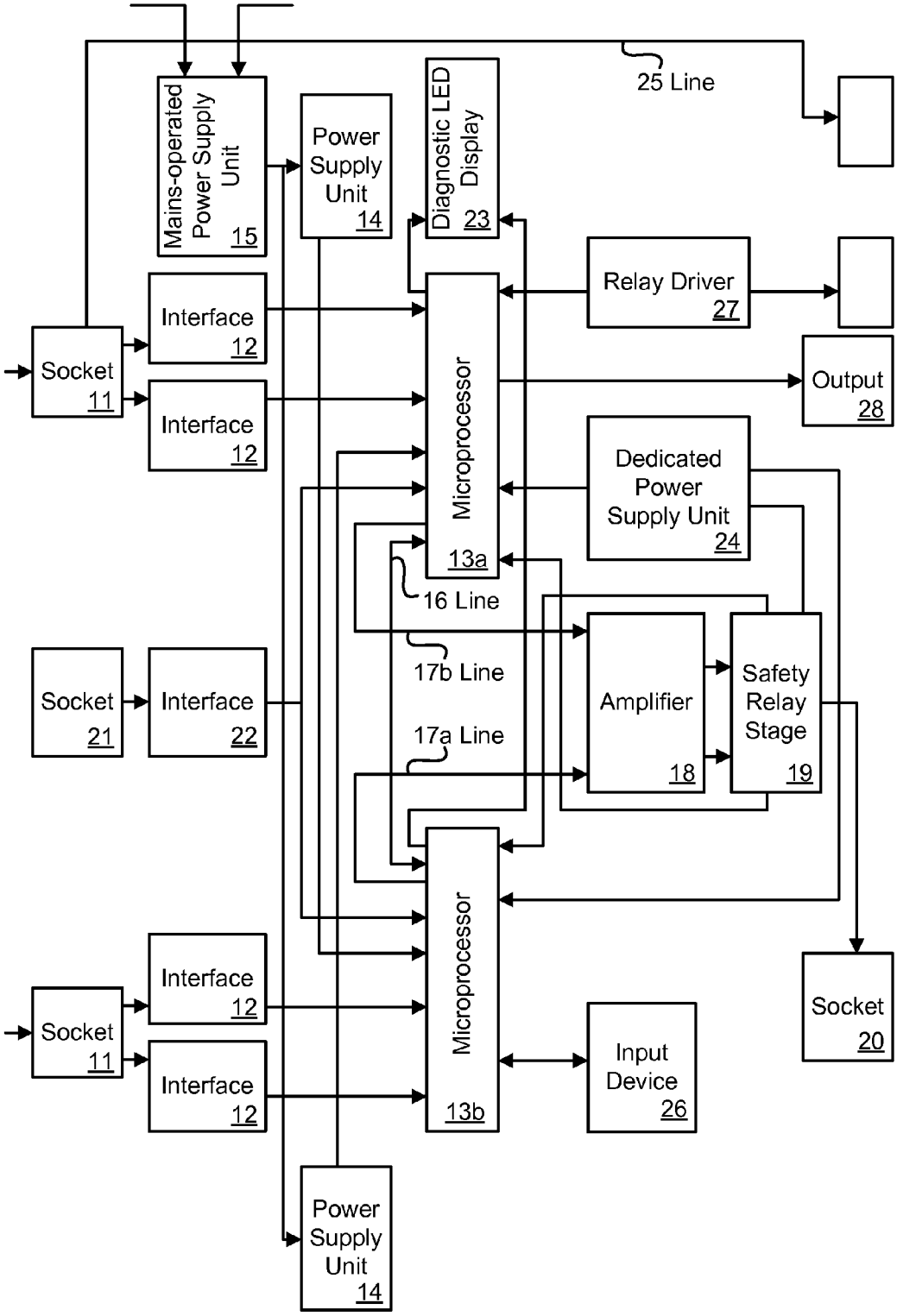
FIG. 2 shows a block diagram of a safety monitoring device for the lift control system from FIG. 1.

In the lift monitoring and control system illustrated in FIG. 1, as a position registering device for a lift car 1 which can be moved along a lift shaft A by means of a traction drive D, the said lift car is provided with a signal injector 2 which is used to inject acoustic signals into an acoustic signal conductor 3 with a predetermined, uniform velocity of propagation of sound, the said acoustic signal conductor extending along the lift shaft. In the two end regions of the acoustic signal conductor 3 there is in each case a receiver unit 4*a* and 4*b*, which comprise a signal extractor 5 and an evaluation unit 6. One of the evaluation units 6 supplies trigger signals corresponding to a predetermined time pattern to the signal injector 2 of the lift car 1, the said signals triggering the injection of an acoustic signal into the acoustic signal conductor 3, and to the other evaluation unit 6, in order that the latter likewise knows the respective triggering time. By using the propagation time of the injected acoustic signal along the acoustic signal conductor 3 from the acoustic signal injector 2 to the two acoustic signal extractors 5 and the velocity of propagation of sound in the acoustic signal conductor 3, the evaluation units 6 in each case separately and redundantly calculate the injection location and therefore the position of the lift car 1.

Instead of this, however, the signal injector 2 can also communicate to the two evaluation units 6 the time at which the acoustic signal is injected, so that both evaluation units 6 can in each case calculate the position of the lift car 1 separately from the predetermined, uniform velocity of propagation of sound and the signal propagation time.

The outputs 7*a*, 7*b* of the evaluation units 6 are used as inputs for a safety monitoring device 8. The latter communicates with a lift control system 9, via which the travel profile of the lift car 1 is predefined, and a safety circuit 10 for switching off the lift drive.

The safety monitoring device 8 comprises two sockets 11, to which the outputs 7*a*, 7*b* of the evaluation units 6 are connected. Via an interface 12, the position signals from the evaluation units 6, which are supplied in a predetermined time pattern corresponding to the trigger signals, are in each case applied to a microprocessor 13*a* and 13*b*, for which a power supply unit 14 is provided in each case. The latter are connected to a mains-operated power supply unit 15 which is also connected to an emergency battery. In this two-channel safety monitoring system, the microprocessors 13*a*, 13*b* communicate with each other via a line 16 for the purpose of mutual monitoring, which means that a crosswise data comparison is carried out, which can also be used to synchronize the two microprocessors 13*a*, 13*b*. By means of the microprocessors 13*a*, 13*b*, the speed and acceleration and, if necessary, a jolting movement of the lift car 1 can be determined instantaneously in a location-dependent manner and compared with a predefined movement profile. In the event of danger, an amplifier 18, which can possibly simultaneously also act as a comparator, can be driven via lines 17*a*, 17*b* in order to switch through only identical output signals present on both microprocessors 13*a*, 13*b*, this amplifier actuating a safety relay stage 19, which—with feedback to the microprocessors 13*a*, 13*b*—acts on the lift control system 9 and the safety circuit 10, which is connected to a corresponding socket 20 of the safety monitoring device 8.

For the signal transmission from the respective socket 11 to the associated microprocessor 13*a* and 13*b*, if appropriate two interfaces 12 can also be provided, in order to be able to process signals from different types of displacement transducers.

Figure 3:
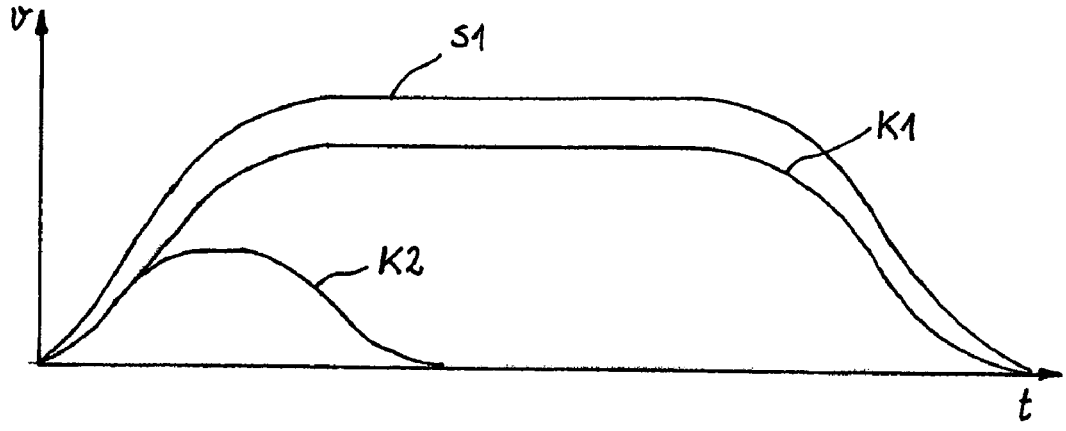
FIG. 3 shows a speed-time graph as a movement profile for a lift car.

FIG. 3, which represents a speed-time graph, shows by way of example a curve K1 which represents the travel profile of a lift car 1 between two further-removed storeys and which is predefined by the lift control system 9. Beginning at the starting time, the curve K1 has a starting ramp up to a nominal speed $v_{nom}$ and a braking ramp from the latter as far as the arrival time. The curve K2 likewise shown in FIG. 3 by way of example is the travel profile between two closely adjacent storeys, the nominal speed $v_{nom}$ not being reached.

If, on account of a fault, the instantaneous speed of the lift car 1 is exceeded by a predetermined amount which is determined as a percentage or in accordance with a desired curve S1 (here for the curve K1), the speed is in a forbidden range. This leads to the microprocessors 13*a*, 13*b*, either simultaneously or within a time window, outputting a corresponding signal which has the effect of stopping the traction drive via the safety relay stage 19. This forms a device for limiting the speed of the lift car 1, which reacts not only to a predetermined exceeding of $v_{nom}$ but also of a speed profile, and thus is correspondingly more capable of reaction.

Since, by means of the microprocessors 13*a*, 13*b*, the speed can be associated with a specific position of the lift car 1, the safety monitoring device 8 can be used at the same time as a device for monitoring retardation in that, if at a specific point in the lift shaft A it is determined that the instantaneous speed of the lift car 1 exceeds a predetermined amount (not necessarily $v_{nom}$), so that braking by means of buffers located in the lift shaft A is no longer ensured, the microprocessors 13*a*, 13*b*, simultaneously or within a time window, output a corresponding signal which has the effect of stopping the traction drive and triggering the braking device via the safety relay stage 19. In this way, smaller-dimensioned buffers can be used, or these can be dispensed with entirely.

At the same time, the safety monitoring device 8 can be used as a monitoring system for the approach with open doors. For this purpose, once again the instantaneous speed of the lift car 1 and its position, that is to say its distance from the next stop, have to be monitored. For this purpose, there must be a request signal from a user from the lift car 1 or from the appropriate storey, which is given to the microprocessors 13*a*, 13*b* for example via a socket 21 belonging to the safety monitoring device 8 and an interface 22. If the request signal arrives too late, because the user has actuated the appropriate knob too late, the speed is too high and the microprocessors 13*a*, 13*b* do not output any bridging signal for the door contacts, so that it is either impossible to start opening the doors before the lift car 1 is at a standstill or the lift car 1 even travels through.

This is correspondingly true of the readjustment of the lift car 1 with the doors open in order to level the floors of the lift car 1 and the storey. In this case, the safety monitoring device 8 again has to output a bridging signal for the door contacts in order that the lift car 1 can be moved appropriately with the doors open.

In the case of ramp travel control, first of all an appropriate authorization signal must be present, for example by means of a key-actuated switch, so that again the safety monitoring device 8 outputs a bridging signal for the door contacts, so that movement of the lift car 1 within a predetermined distance interval is made possible and is monitored by the microprocessors 13*a*, 13*b* via the position of the lift car 1. A signal to stop the traction drive D is then generated at the limits of the distance interval.

If necessary, the safety monitoring device 8 can also be used to create a virtual protective space for example on the top and/or pit side of the lift shaft A, for example when work is being carried out in this region, that is to say in response to a corresponding request signal, the distance over which the lift car 1 can travel is limited appropriately, so that penetration into the virtual protective space is prevented.

In a corresponding way, the microprocessors 13*a*, 13*b* can additionally also be used in relation to the acceleration and the derivative hereof (the latter in order to assess jolting movements).

In addition, the function of appropriate emergency limit switches for the distance over which the lift car 1 can travel or other safety switches can likewise be performed by the safety monitoring device 8.

If appropriate, the evaluation units 6 will only carry out appropriate signal conditioning of the position signals, while the microprocessors 13*a*, 13*b* themselves perform the actual calculation of the position of the lift car 1.

A diagnostic LED display 23 can be coupled to the microprocessors 13*a*, 13*b*. The safety relay 19 can also have a dedicated power supply unit 24, which is in turn monitored by the microprocessors 13*a*, 13*b*. The respective position of the lift car 1 is transmitted to the lift control system 9 either from the position registering device via a line 25 or from one of the microprocessors 13*a*, 13*b*. Necessary data can be entered into the microprocessors 13*a*, 13*b* via an input device 26 in the form of a keyboard or the like. Likewise, the data can also be received from the lift control system 9 via the line 25. If necessary, the appropriate starting or braking ramp or the complete movement profile or the switching points derived from the latter, if these are not predefined by the lift control system 9, can be supplied to the lift control system 9 from one of the microprocessors 13*a*, 13*b* via a data-bus or relay driver 27. If appropriate, there can also be an output 28 which indicates the alignment between the floors of the lift car 1 and storey.

Although the embodiment described above has been described in connection with a specific position registering device, it can be seen that this does not matter, but that what matters is that appropriate signals which are representative of the instantaneous position of the lift car 1 are supplied by a position registering device.

While the invention has been shown and described with reference to the preferred embodiment, it should be apparent to one ordinary skilled in the art that many changes and modifications may be made without departing from the spirit and scope of the invention as defined in the claims.

What is claimed, is:

1. A safety monitoring device for a lift car which is moveable in a lift shaft by means of a traction drive via a lift control system and whose instantaneous position is registratable by means of a position registering device which supplies two position signals, produced independently of each other, in a predetermined time pattern, having two-channel evaluation of the position signals by means of a microprocessor in each case for location-dependent, instantaneous determination of the speed of the lift car obtained from the two-channel evaluation of the position signals and for comparison with a predefined movement profile, wherein the two microprocessors communicate with each other via a line for mutual monitoring, in the case a predetermined instantaneous speed desired value is exceeded it being provided to generate a trigger signal outputed via a safety relay stage.

2. The device according to claim 1, wherein the instantaneous acceleration and/or a derivative of the acceleration of the movement of the lift car is determined by the microprocessors and compared with the predefined movement profile, it being possible for a trigger signal to be generated if a predetermined desired value is exceeded.

3. The device according to claim 1, wherein the microprocessors is synchronized by means of crosswise data comparison.

4. The device according to claim 1, wherein retardation monitoring with triggering of the action of stopping the traction drive and braking the lift car can be performed.

5. The device according to claim 1, wherein limiting the speed of the lift car with triggering of the action of stopping the traction drive and braking the lift car performable.

6. The device according to claim 1, wherein moving the lift car into a stopping position and/or readjusting the stopping position of the lift car and/or ramp travel control is performable, in each case with the doors open and while bridging the door switches.

7. The device according to claim 1, wherein a virtual protective space of predefined length can be generated temporarily in at least one end region of the lift shaft.

8. The device according to claim 1, wherein the function of emergency limit switches can be carried out.

* * * * *